United States Patent [19]

Akkerman

[11] 4,058,250

[45] Nov. 15, 1977

[54] REINFORCED SIDE CARRY CARTON

[75] Inventor: Allardus A. Akkerman, Calgary, Canada

[73] Assignee: Domtar Limited, Montreal, Canada

[21] Appl. No.: 682,997

[22] Filed: May 4, 1976

[51] Int. Cl.[2] ..... B65D 5/46; B65D 25/22

[52] U.S. Cl. ..... 229/52 B

[58] Field of Search ..... 229/52 B, 49

[56] References Cited

U.S. PATENT DOCUMENTS

| | | | |
|---|---|---|---|
| 2,216,299 | 10/1940 | Schilling | 229/52 B X |
| 2,481,871 | 9/1949 | Potts | 229/52 B |
| 2,710,135 | 6/1955 | Gaylord | 229/52 B |
| 3,533,549 | 10/1970 | Gilchrist | 229/52 B X |
| 3,696,990 | 10/1972 | Dewhurst | 229/52 B |

FOREIGN PATENT DOCUMENTS

| | | | |
|---|---|---|---|
| 741,189 | 8/1966 | Canada | 229/52 B |
| 786,187 | 5/1968 | Canada | 229/52 B |

*Primary Examiner*—Davis T. Moorhead
*Attorney, Agent, or Firm*—C. A. Rowley

[57] ABSTRACT

A side carry carton having a top wall and a front wall interconnected by a flap forming the manufacturer's joint and hand hole panel formed in the front wall in part by a fold line spaced from the top wall is provided with an extension foldably connected to the manufacturer's joint forming the flap by a first fold line co-extensive with the hand hole forming fold line. The first fold line impairs folding of the extension into the carton at an angle of over approximately 90°. Preferably the extension will extend the full length of said manufacturer's joint flap and said front wall. Folding of said hand hole forming panel into the carton causes the extension to fold relative to said manufacturer's joint flap whereby the hand hole is reinforced and the binding of the front wall of the carton is impaired.

8 Claims, 5 Drawing Figures

FIG. 5

REINFORCED SIDE CARRY CARTON

The present invention relates to a side-carry carton. More specifically the present invention relates to a side carry carton for beverages and the like wherein the hand hole is reinforced by means of an internal flap extending substantially the full length of the carton.

Side carry cartons for beverages are well known and have been in use in the beer industry particularly in Alberta and New Brunswick since about 1968. The basic structure of these cartons is disclosed in Can. Patent No. 786,187 issued May 28, 1968 to Gordon Gilchrist. This carton has functioned very well over the past seven years and has proved to be one of the most economical cartons for packaging 12 bottles of beer for the retail market.

The above carton generally incorporated a reinforcing tape immediately above the handle to strengthen the handle and prevents ripping of the front panel should the carton receive extreme rough handling. This tape, increases the cost of the carton and thus means for replacing the tape would be desirable.

It has been proposed to reinforce a hand hole in a carton of similar structure to that disclosed in the above described Canadian patent by folding a portion of the manufacturer's joint flap with the handle so that as the handle is folded into the carton the flap backing the handle (the manufacturer's joint forming flap) also folds in the area immediately behind the handle whereby the fold at the top of the handle includes several thicknesses of material folded back on itself. Such a handle reinforcement is shown, for example, in Canadian Patent No. 741,189 issued Aug. 23, 1966 to Belkin.

The reinforcement taught in the said Canadian Patent No. 741,189 only strengthens the carton in the area of the manufacturer's joint forming flap and only along a length commensurate with the fold line at the top of the hand hole. It has been later proposed to extend the reinforcing flap slightly on either side of the hand hole. This later arrangement may improve the strength of the hand hole slightly.

It has also been proposed to secure a fibreboard strip of about 16 point caliper or less, (approximately equivalent to a sheet of kraft paper) to the inner face of a panel with fold line in the fibreboard strip substantially in line with the fold line at the top of the handle so that the fibreboard strip is bent with the handle panel when the handle panel is moved into the carton to carrying position (see U.S. Pat. No. 2,710,135 issued June 7, 1955, Gaylord). With this arrangement with fibreboard strip folds with the hand hole into a position in face to face relationship with itself and functions to reinforce the top of the hand hole to inhibit tearing.

The present invention provides a reinforcement for a hand hole which impairs tearing of the hand hole and buckling of the wall of the container through which the hand hole is cut. It is of particular value where the hand hole is positioned in the center of a long wall, e.g. the center of the long wall of a beer carton for containing a dozen beer in 6 × 2 relationship.

Broadly the present invention comprises a side carry carton and blank therefore having a top wall, rear wall, bottom wall, front wall foldably interconnected, a flap for forming the manufacturer's joint foldably connected to the top wall and secured in face to face relationship with the inside of the front wall and extension foldably connected to said flap by a first fold line, said first fold line inhibiting folding of said extension inward of said carton through an angle greater than approximately 90°, a handle panel defined in the front wall by a substantially U-shaped slit and second a fold line joining the ends of the U-shaped slit, said second fold line being positioned at the top of the handle panel, said first and second fold line being substantially in alignment in the finished carton. Preferably said extension will extend substantially the full length of said front wall to inhibit bowing of said front wall.

The present invention also provides a carton blank for forming the carton of the present invention.

Further features, objects and advantages will be evident from the following detailed description of the preferred embodiments of the present invention taken in conjunction with the accompanying drawings in which.

Figure 1:
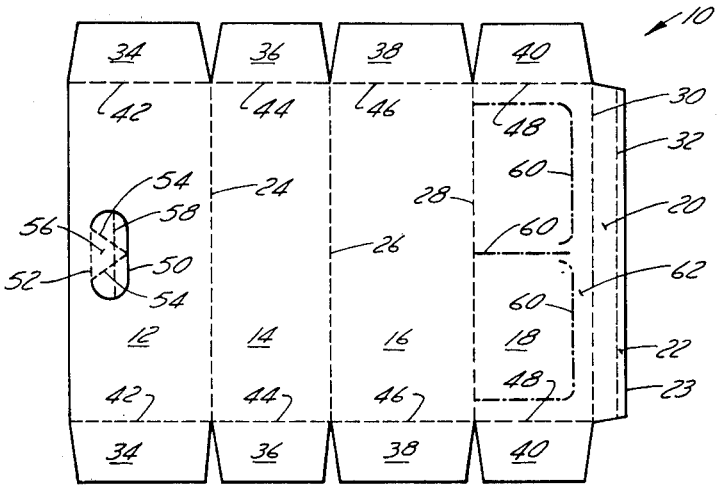
FIG. 1 is a plan view of a blank for forming the carton of the present invention.
Figure 2:
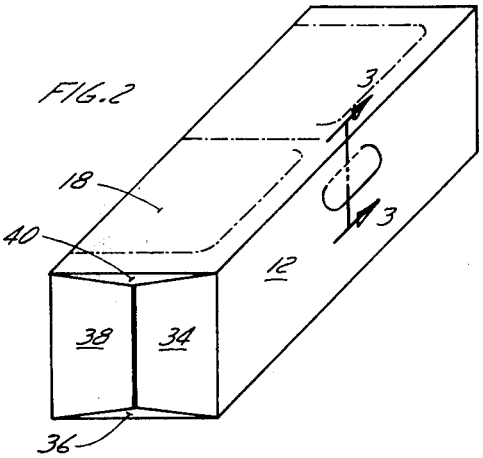
FIG. 2 is an isometric view of the carton constructed from the blank of FIG. 1.

As shown in FIG. 1 the blank 10 has a front wall 12, bottom wall 14, rear wall 16, top wall 18, manufacturer's joint forming flap 20 and an extension 22 interconnected by a set of substantially parallel fold lines 24, 26, 28, 30 and 32. It will be noted that the flap 20 and extension 22 extend substantially the full length of the carton. End wall forming flaps 34, 36, 38 and 40 are connected to opposite ends of the front, bottom, rear and top panels by fold lines 42, 44, 46 and 48 respectively.

The front wall has a centrally located hand hole forming panel 56 formed therein by a U-shaped slit 50 the ends of which are interconnected by a fold line 52 as ilustrated. A pair of diagonal fold lines 54 in panel 56 permit folding of the panel 56 between bottles contained in the carton and a fold line 58 substantially parallel to fold line 52 permits folding of the free edge of the panel 56 into face to face relationship with the top of the carton.

Figure 3:
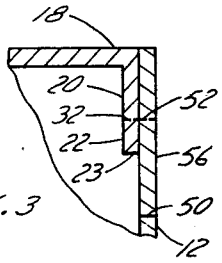
FIG. 3 is a partial section view of the front wall, top wall of the line 3—3 of FIG. 2.

The spacing between the fold lines 30 and 32 is equivalent to the spacing between the top edge of the front panel 12 and the fold line 52 so that the fold lines 32 and 52 are in substantial alignment as shown in FIG. 3 in the finished carton.

The fold line 32 is constructed to permit the extension 22 to fold relatively easily into a position substantially perpendicular to the glue flap 20 and thereafter to resist further folding, i.e., the extension 22 may be folded into the carton to a position substantially perpendicular to the front wall and then further folding becomes more difficult. This type of fold line preferably is obtained by a single score from the inside face of the board, i.e., from the face of the board forming the inside of the carton. Generally a single male die of appropriate thickness for the board entering the board from its inside face will provide the required type of fold line.

To ensure that the extension 22 does not become secured to the front wall 12 it is preferred to crush the extension 22, i.e., flatten the corrugations in this area of the blank and to print along this crushed area to inhibit operation of adhesive. This crushing of the extension 22 also facilitates folding of the extension 22 with the hand hole panel.

The distance between said fold line 32 and the free edge 23 of the extension 22 is less than the distance between the fold lines 52 and 58. If the extension is too long, i.e. the distance between the fold line 32 and the free edge 23 is too long folding of the extension will be impaired by the shoulders of the bottles. It is preferred to make the extension 22 as long as possible without the folding of the extension being impaired by the shoulders of the bottles at least long enough to provide significant strength improvement.

The top panel 18 is provided with suitable opening means formed by lines of weakness as designated by the dot dash lines 60. In the specific arrangement shown the lines of weakness 60 form a C-shaped reinforcement 62 extending around three sides of the top panel to reinforce the hand hole or front panel to prevent bowing, however, any suitable opening means may be used. The reinforcing provided by the extension 22 reduces the requirement for the C-shaped reinforcing rim 62 however this rim 62 is preferred.

To construct a carton of the present invention the panel 18 is folded on the fold line 28 to position the panel 18 and the flap 20 and extension 22 in overlying relationship with the panel 16 and 14. Next the front panel 12 is folded in overlying relationship with the panel 14 and the manufacturer's joint flap 20 and its extension 22. Adhesive on the manufacturer's joint flap between the fold lines 30 and 32 to secure the manufacturer's joint forming flap to the panel 12 in the area bounded by the fold lines 30 and 32 and the free end edges of the flap 20, thereby leaving the extension 22 free be folded on fold line 32 away from the panel 12.

Figure 4:
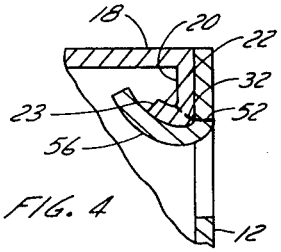
FIG. 4 is a view similar to FIG. 3 illustrating the hand hole in open position.
Figure 5:
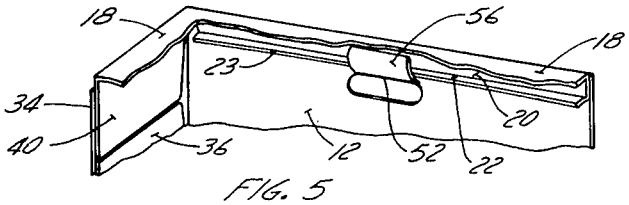
FIG. 5 is a partial isometric view of the inside of the carton illustrating the folding of the manufacturer's joint with the handle in one embodiment of the present invention.

In use the hand forces the panel 56 into the carton by folding on line 52 which in turn folds the extension 22 relating to plys 30 on fold line 32 as shown in FIG. 4. The extension 22 is folded to approximately the 90° position as illustrated in FIGS. 4 and 5 and further folding of the extension is inhibited due to the type of fold line formed along the fold line 32. This provides a resilient support for the carton as the fingers inserted through the hand hole tend to carry the carton by pressure applied adjacent the free edge 23 of the extension 22, i.e., the carton is supported primarily at the free edge 23 of the extension 22. This system of resiliently supporting the load, i.e., due to the bending of the extension 22 from the fold line 32 to its free end 23 and the resilience in the fold line 32 itself provides a stronger handle structure. Also it will be apparent that folding the extension 22 into the position illustrated in 4 and 5 provides and L-shaped beam extending along the full length of the front panel thereby increase the moment of inertia of the front panel and inhibits bending of this panel. Furthermore, the forces applied to the manufacturer's joint flap by the hand hole are distributed over longer lengths and thus the unit stress applied to the hand hole and manufacturer's joint flap are reduced.

It is preferred that the manufacturer's joint flap and the extension 22 extend substantially the full length of the carton, however, it is apparent that if the extension were slightly shorter there would be a slight reduction in the strength of the carton. Thus while it is preferred to make extension 22 substantially the full length this is not absolutely essential.

The extension 22 has also been shown completely free to fold. Conceivably the extension 22 could be secured adjacent its lateral free ends (adjacent the end flaps) to the front wall. This would require twisting or bending action of the board the central non secured portion of the extension 22 when the handle panel is folded into the box. Such an arrangement is not preferred and would make folding in of the handle panel more difficult without increasing the strength of the box significantly over that obtained when the extension if free.

Modifications may be made without departing from the spirit of the invention as defined in the appended claims.

I claim:

1. A blank for forming a side carry carton comprising a front wall, bottom wall, rear wall, top wall, and manufacturer's joint forming flap interconnected by a set of substantially parallel fold lines, an extension of said manufacturer's joint forming flap connected to said flap by a first fold line substantially parallel to said set of fold lines, said first fold line on said extension inhibiting folding of said extension inward of a finished carbon made from said blank through more than approximately 90° relative to said flap, a handle panel formed in said front wall by a substantially U-shaped slit and a second fold line interconnecting the opposite ends of said U-shaped slit, said second fold line being substantially parallel to said set of fold lines and being spaced from the top edge of said front panel by a distance to permit said first and second fold lines to be substantially in alignment when said carton is constructed, said first fold line on said extension and said extension extending laterally from opposite ends of said second fold line.

2. A blank as defined in claim 1 wherein said extension extends substantially the full length of said flap.

3. A blank as defined in claim 1 wherein said flap and said extension extend substantially the full length of said front wall.

4. A blank as defined in claim 1, wherein said first fold line is by a single score indented into the blank from the side thereof which will form the inside of the carton.

5. A carton comprising a front wall, bottom wall, rear wall and top wall foldably interconnected, a manufacturer's joint forming flap foldably connected to said top wall and secured in face to face relationship with the inside of said front wall adjacent the top edge of said front wall, an extension connected to said manufacturer's joint flap by a first fold line substantially parallel to said top wall, said first fold line on said extension inhibiting folding of said extension into said carton through an angle of greater than approximately 90° to said flap, a hangle forming panel defined in said front wall by a substantially U-shaped slit and a second fold line interconnecting the ends of said U-shaped slit, said second fold line being substantially parallel to said top wall and closer to said top wall than said U-shaped slit and being in substantial alignment with said first fold line whereby folding of said handle panel into said carton folds said extension on said first fold line, said extension and said first fold line projecting laterally from opposite ends of said second fold line.

6. A carton as defined in claim 5 wherein said extension extends substantially the full length of said flap.

7. A carton as defined in claim 5 wherein said flap and said extension extend substantially its full length of said front wall.

8. A carton as defined in claim 5 wherein said first fold line is formed by a single score indented into the material from which the carton is made from the inside face thereof.

* * * * *